United States Patent [19]

Sakai

[11] Patent Number: 4,665,724

[45] Date of Patent: May 19, 1987

[54] WIRE LOCK

[75] Inventor: Tadashi Sakai, Seto, Japan

[73] Assignee: Kabushiki Kaisha Saikousha, Kasugai, Japan

[21] Appl. No.: 740,415

[22] Filed: Jun. 3, 1985

[30] Foreign Application Priority Data

Jun. 19, 1984 [JP] Japan ..... 59-91266[U]

[51] Int. Cl.[4] ..... E05B 37/02

[52] U.S. Cl. ..... 70/30

[58] Field of Search ..... 70/18, 30, 49, 233; 242/107.3, 107.4 R, 107.6, 107.7

[56] References Cited

U.S. PATENT DOCUMENTS

| | | | |
|---|---|---|---|
| 199,468 | 1/1878 | Rheubottom | 70/49 |
| 639,196 | 12/1899 | Fehling | 70/18 |
| 2,190,661 | 2/1940 | Hauer | 70/49 |
| 3,693,596 | 9/1972 | Croce et al. | 242/107.6 |
| 3,906,758 | 9/1975 | Hurwitt | 70/49 |
| 4,033,160 | 7/1977 | Mima | 70/49 |
| 4,086,795 | 5/1978 | Foster et al. | 70/49 |
| 4,543,806 | 10/1985 | Papandrea et al. | 70/30 |

FOREIGN PATENT DOCUMENTS

| | | | |
|---|---|---|---|
| 123470 | 11/1948 | Sweden | 70/58 |

*Primary Examiner*—Thomas J. Holko
*Assistant Examiner*—Suzanne L. Dino
*Attorney, Agent, or Firm*—Oblon, Fisher, Spivak, McClelland & Maier

[57] ABSTRACT

A wire lock comprising a take-up unit which encloses therein a locking wire so that the wire can be drawn out against the biasing force of a spring and rewound by the same force. A locking member is connected to a projecting end of the wire. The locking member can be brought into engagement for locking can be disengaged for unlocking only by a preset unlocking means. A movement preventing means prevents the movement of the wire at least in the drawing-out direction of the wire. The movement preventing means is attached to the take-up unit so that the inhibition of the wire movement can be released manually. With this construction, a locked object suspended from the wire lock can be carried while holding the wire lock by hand.

3 Claims, 8 Drawing Figures

WIRE LOCK

BACKGROUND OF THE INVENTION (1) Field of Art

The present invention relates to a wire lock comprising a take-up unit which encloses therein a wire for passing, for example, between a bicycle handle and a wheel so that the wire can be drawn out and rewound, and a lock with which a locking member connected to the fore end of the wire is brought into engagement for locking so that it can be disengaged therefrom for unlocking.

(2) Prior Art

Heretofore, there has been known a wire lock comprising a take-up unit and lock attached thereto integrally, in which a wire is mounted in the take-up unit so as to be rewindable automatically by means of a spring, and a locking member connected to the fore end of the wire is brought into engagement with the lock for locking so that it can be disengaged therefrom for unlocking. In such conventional wire locks as ordinary types of cord reel and convex, a latch mechanism for preventing the automatic rewinding tendency of the wire induced by the biasing force of the spring in any desired drawing-out position, without preventing the drawing out of the wire against the biasing force of the spring, is provided so that the inhibition of the rewind can be released manually. However, in the case where the wire is passed in the form of a loop through grip portions of plural cases, bags, or the like, then its fore end is inserted for locking into the lock integral with the take-up unit, and the take-up unit for the wire is lifted by hand, the wire will be drawn out automatically because it is impossible to prevent it, thus causing inconvenience in carrying it. Moreover, for example, in the case where two bicycles are locked by passing the wire between the handles of the bicycles and fitting it into the lock, the wire may be further drawn out because it is impossible to prevent it. Consequently, the wire may be removed from the handles of both bicycles even without releasing the locked state, and in this case the wire lock is no longer of use.

SUMMARY OF THE INVENTION

According to the present invention, there is provided a wire lock including an automatic take-up unit and a movement preventing means for preventing the drawing out of wire in any desired position, whereby an object suspended from the wire can be carried while lifting the wire lock by hand.

As shown in FIG. 1, the present invention resides in a wire lock 8 comprising a take-up unit 3 which encloses therein a locking wire 2 so that the wire can be drawn out against the biasing force of a spring 1 and rewound by the same force; a lock 6 with which a locking member 4 connected to a projecting end of the wire 2 is brought into engagement for locking so that it can be disengaged therefrom for unlocking only by a preset unlocking means 5; and a movement preventing means 7 for preventing the movement at least in the drawing-out direction of the wire 2; the movement preventing means 7 being attached to the take-up unit 3 so that the inhibition of the wire movement can be released manually.

DETAILED DESCRIPTION OF PREFERRED EMBODIMENTS

Figure 1:
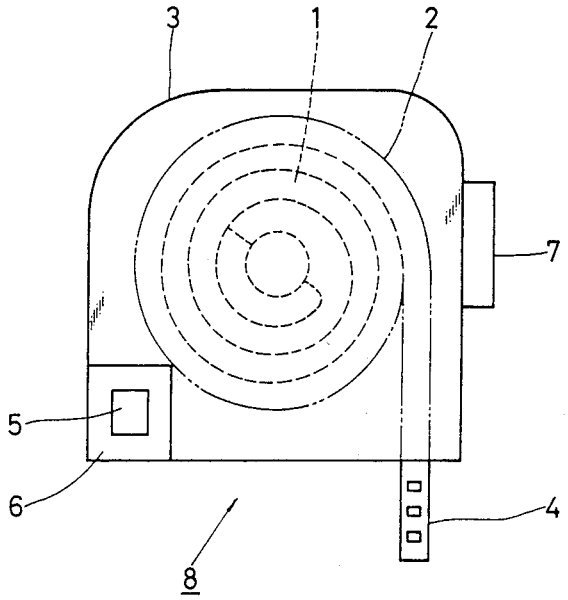
FIG. 1 illustrates an entire construction of the present invention.

The construction of a first embodiment of the present invention will be described below with reference to FIGS. 2 and 3.

A take-up unit 11 integral with a combination lock 10 encloses therein a locking wire 12 to be engaged with an object to be locked, for example, between a frame and a wheel of a bicycle, the wire 12 being mounted so as to be rewindable automatically by the biasing force of a spring 13. More specifically, the spring 13 is retained between a shaft 15 of a body case 14 of the take-up unit 11 and a take-up disc 16 which is rotatable about the shaft 15 and to which one end of the wire 12 is connected, and the wire 12 is mounted so as to be rewindable automatically by virtue of rotation of the take-up disc 16 induced by the biasing force of the spring 13. To the other end of the wire 12 is connected a locking member 17 which also serves as an end stopper at the time of rewinding (FIG. 2 shows a completely rewound state) and which is provided as a pair with the combination lock 10.

Between side walls 18 of the take-up unit 11 with combination lock 10 thus constructed is disposed a movement preventing means; more specifically, a latch disc 19 in combination integrally with the take-up disc 16, and a latch lever 20 adapted to retain the latch disc 19 only in the rewinding direction of the wire 12 is mounted pivotably about a shaft 22 while being urged in the direction of abutment on the latch disc 19 by means of a spring 21. Further, at the end face of the latch lever 20 on the side opposite to the latch side is mounted a retaining piece 23 as a movement preventing means pivotably about a shaft 25. Axial movement of the retaining piece 23 is prevented by a snap ring 24. The retaining piece 23 may be stably positioned either as shown in solid line or as shown in alternate long and two short dashes line in FIG. 3 by means of a notch mechanism 29 which comprises a ball 26, a spring 27 and two recesses 28 formed on the surface of the retaining piece 23. More particularly, in FIGS. 2 and 3, as the retaining piece 23 begins pivoting from the solid line position to the broken line position about the shaft 25, the ball 26 is pushed down by the retaining piece 23, so that the spring 27 is compressed and the ball 26 becomes disengaged from one recess 28. Then, when the retaining piece 23 turns about 90 degrees, the ball 26 fits in the other recess 28 closely, and the spring 27 pushes up the ball 26.

Figure 2:
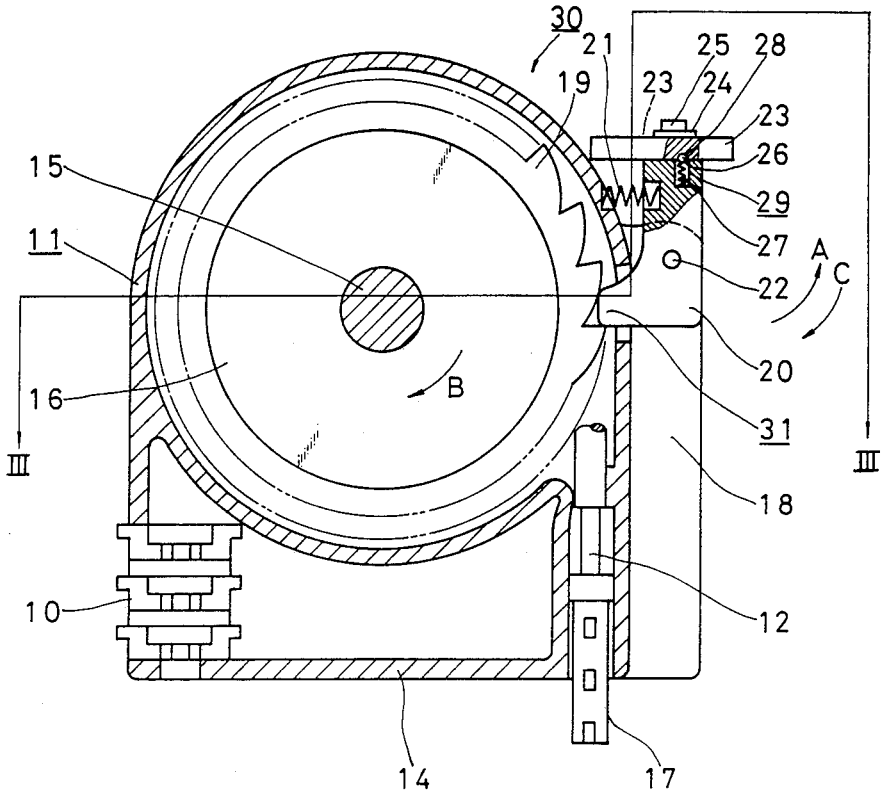
FIG. 2 is a front view of a first embodiment of the present invention, partially broken away.
Figure 3:
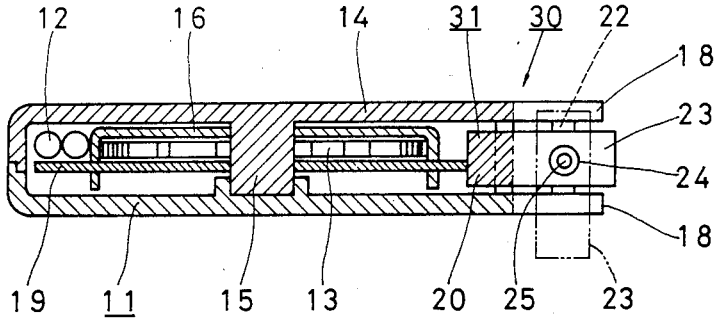
FIG. 3 is a sectional view taken on line III—III of FIG. 2.

In this embodiment, as indicated in the solid line in FIG. 3, the retaining piece 23 is in the form of a rectangular plate, and in this solid line position it is in close abutment on the outer surface of a wire lock 30. Thus, the retaining piece 23 serves as a prop to prevent the latch lever 20 from pivoting in the direction of arrow A in FIG. 2 about the shaft 22, whereby the latch disc 19 is prevented from rotating in the direction of arrow B in FIG. 2, and therefore the wire 12 cannot be drawn out from the wire lock 30.

In the wire lock 30 thus constructed, as the retaining piece 23 is turned from the solid line position to the alternate long and two short dashes line position about the shaft 25 in FIG. 3, a latch mechanism 31 exhibits its latching function. More particularly, as the retaining piece 23 pivots from its solid line position, it becomes no longer abutted on the wire lock 30, so that a space is formed between the retaining piece 23 and the lock 30, thus permitting the latch lever 20 to pivot in the direction of arrow A about the shaft 22 integrally with the retaining piece 23 which is connected to the latch lever 20 through the shaft 25. In this case, since the spring 21 urges the latch lever 20 toward the direction of C by virtue of its elasticity force, the latch disc 19, which is serrated, can rotate in the direction of arrow B while being in sliding contact with an end portion of the latch lever 20. On the other hand, its rotation in the direction opposite the direction of arrow B is prevented because a tooth of the serrated latch disc 19 is locked by the latch lever 20 being biased by the spring 21. Thus, the wire 12 cannot be rewound although it can be drawn out; that is, the movement of the wire 12 is prevented only in the rewinding direction. Consequently, the wire 12 can be drawn out, then brought into engagement with an object to be locked and then fitted in the combination lock 10.

If in this state the retaining piece 23 is brought to the solid line position in FIGS. 2 and 3, not only the latch lever 20 but also the latch disc 19 is prevented from rotating in the drawing-out direction, so that both rewinding and drawing-out of the wire 12 are prevented. Even if the locked object is lifted in this state through the wire 12 by hand, the wire 12 will not be drawn out, thus permitting, for example, walking while allowing the locked object to be suspended from the wire 12. By returning the retaining piece 23 to its alternate long and two short dashes line position in FIG. 3, the latching function can be exhibited again.

Figure 4:
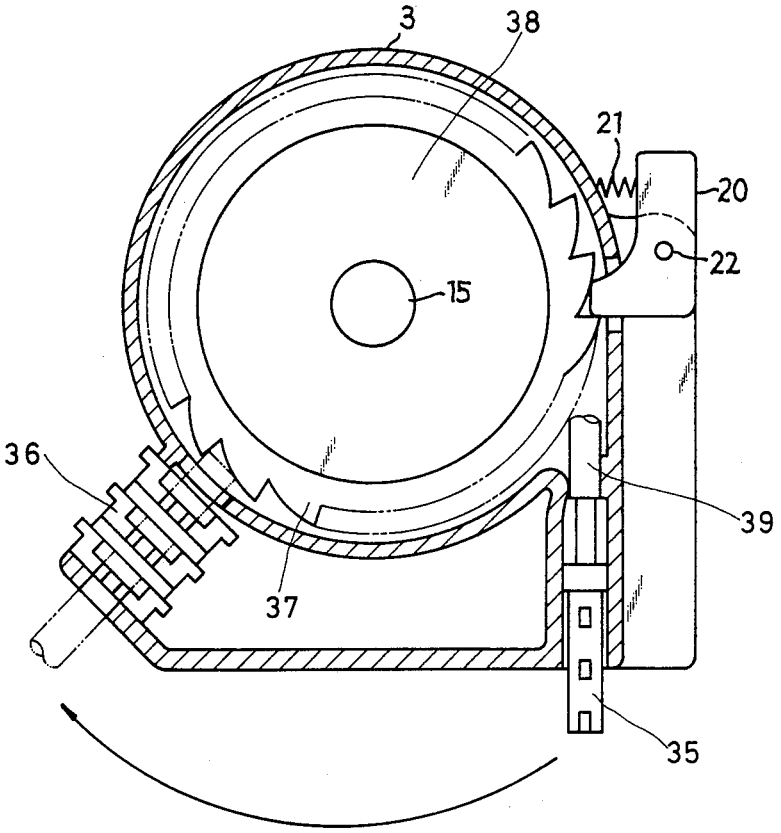
FIG. 4 is a front view of a second embodiment of the present invention, partially broken away.

Referring now to FIG. 4, there is illustrated a second embodiment of the present invention, in which when a locking member 35 is inserted in a combination lock 36, a fore end portion of the locking member 35 engages a latch disc 37 to prevent the rotation of both the latch disc 37 and a take-up disc 38 and prevent both rewinding and drawing out of a wire 39, whereby in a locked state the wire 39 is prevented from being drawn out and disengaged from a locked object. Other constructional points, function and effect are almost the same as those in the first embodiment.

Figure 5:
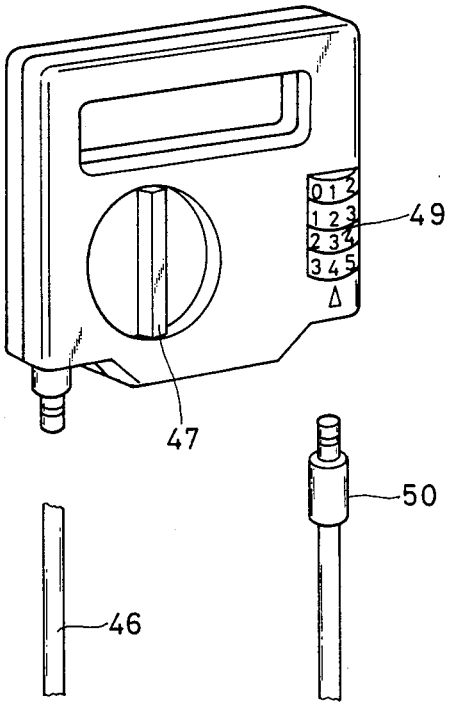
FIG. 5 is a perspective view of a third embodiment of the present invention.

FIG. 5 illustrates a third embodiment of the present invention, in which a movement preventing means 47 is provided at the center of a wire lock body, and a dial 49 is provided. The movement preventing means 47 prevents a wire 46 from moving in rewinding and drawing-out directions. By setting the dial 49 to predetermined numerals, a locking member 50 is unlocked.

Figure 6:
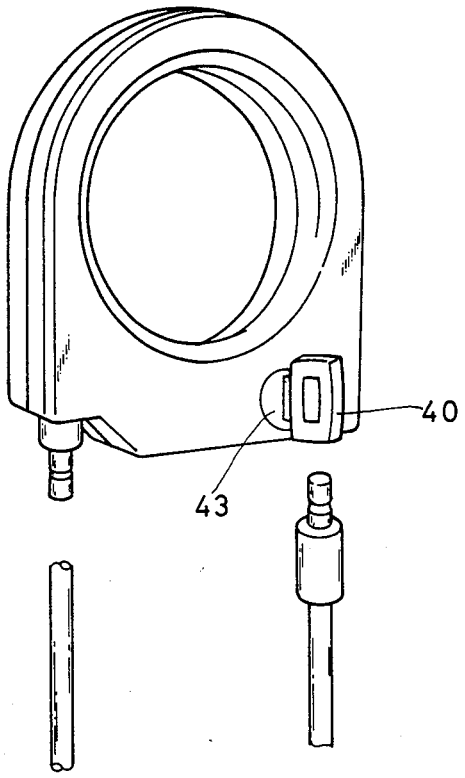
FIG. 6 is a perspective view of a fourth embodiment of the present invention.

FIG. 6 illustrates a fourth embodiment of the present invention, in which a cylinder 43 is locked and unlocked using a key 40.

Figure 7:
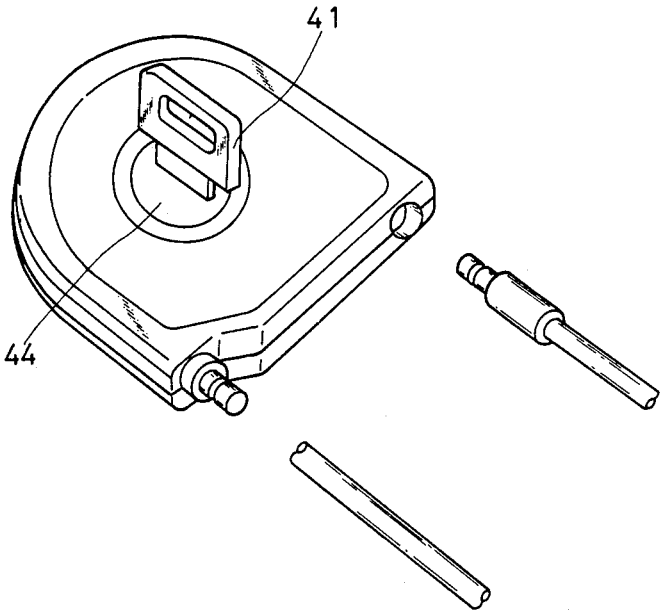
FIG. 7 is a perspective view of a fifth embodiment of the present invention.

FIG. 7 illustrates a fifth embodiment of the present invention, in which a cylinder 44 is locked and unlocked using a key 41.

Figure 8:
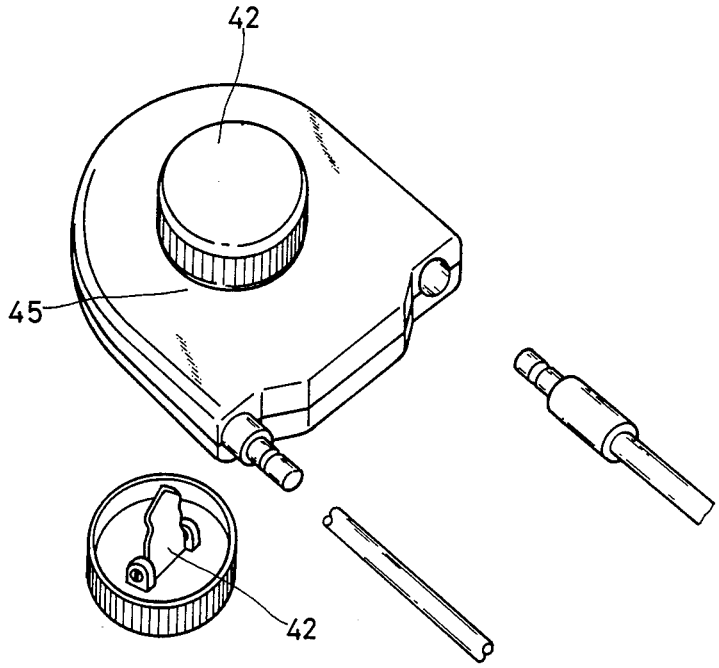
FIG. 8 is a perspective view of a sixth embodiment of the present invention.

FIG. 8 illustrates a sixth embodiment of the present invention, in which a cylinder 45 is locked and unlocked using a key 42.

What is claimed is:

1. A wire lock comprising:

(a) a take-up unit;

(b) a fixed shaft mounted in said take-up unit;

(c) a wire wound around said fixed shaft and having a fore end extending outside said take-up unit, said wire being capable of movement relative to said take-up unit to vary the amount of said wire extending outside said take-up unit;

(d) a latch disc rotatably mounted on said fixed shaft, said latch disc having a plurality of ratchet serrations on the external periphery thereof;

(e) a first spring operatively connected to said wire to bias said wire to retract within said take-up unit;

(f) a pawl mounted on said take-up unit in position to operatively engage said ratchet serrations on said latch disc, said pawl being movable back and forth between a first position in which it prevents rotation of said latch disc in one direction and a second position in which it permits rotation of said latch disc in either direction;

(g) a combination lock mounted on said take-up unit; and (h) a locking mcmber mounted on said fore end of said wire, said locking member being sized and shaped to be releasably held by said combination lock and so that, when said locking member is held by said combination lock, said locking member extends into said take-up unit and engages said ratchet serrations on said latch disc, preventing rotation of said latch disc in ether direction.

2. A wire lock as recited in claim 1 and further comprising a second spring biasing said pawl towards its first position.

3. A wire lock as recited in claim 1 wherein:

(a) said locking member has a fore end and (b) said fore end of said locking member passes through said combination lock before it engages said rachet serrations on said latch disc.

* * * * *